United States Patent [19]

Strehlow

[11] Patent Number: 4,951,260

[45] Date of Patent: Aug. 21, 1990

[54] INTEGRAL DUST HOOD FOR TILT MIXER DRUM

[75] Inventor: Robert W. Strehlow, New Berlin, Wis.

[73] Assignee: McNeilus Truck and Manufacturing, Inc., Dodge Center, Minn.

[21] Appl. No.: 483,172

[22] Filed: Feb. 22, 1990

[51] Int. Cl.[5] ..... B28C 7/16; B28C 5/20

[52] U.S. Cl. ..... 366/045; 366/63; 366/185; 366/187

[58] Field of Search ..... 366/44, 45, 46, 54, 366/55, 57, 60, 61, 185, 220, 228, 233, 187, 188, 18, 16, 28, 53, 62, 63

[56] References Cited

U.S. PATENT DOCUMENTS

| | | | |
|---|---|---|---|
| 2,133,170 | 10/1938 | Johnson | 366/45 |
| 2,175,464 | 10/1939 | Hoya | 366/45 |
| 3,446,487 | 5/1969 | Strehlow | 366/45 |

*Primary Examiner*—Robert W. Jenkins

*Attorney, Agent, or Firm*—Haugen and Nikolai

[57] ABSTRACT

An improved integrally mounted and operated dust hood is disclosed for a tilt mixer which minimizes the environmental effect of dust formed in the mixer which escapes from the discharge end of the drum. The integrally mounted dust hood of the invention includes a shaped sheet metal hood member which is hinge mounted from the forward drum support and operates in conjunction with the tilting of the mixer.

13 Claims, 2 Drawing Sheets

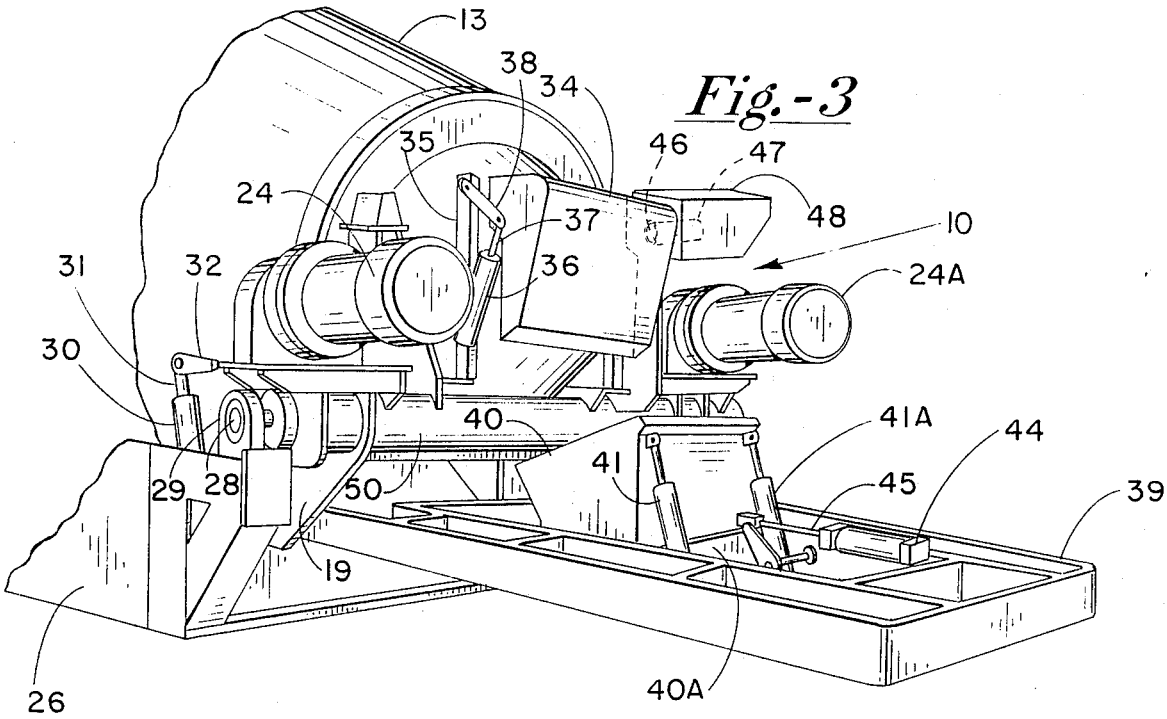
Fig.-3
Fig.-4
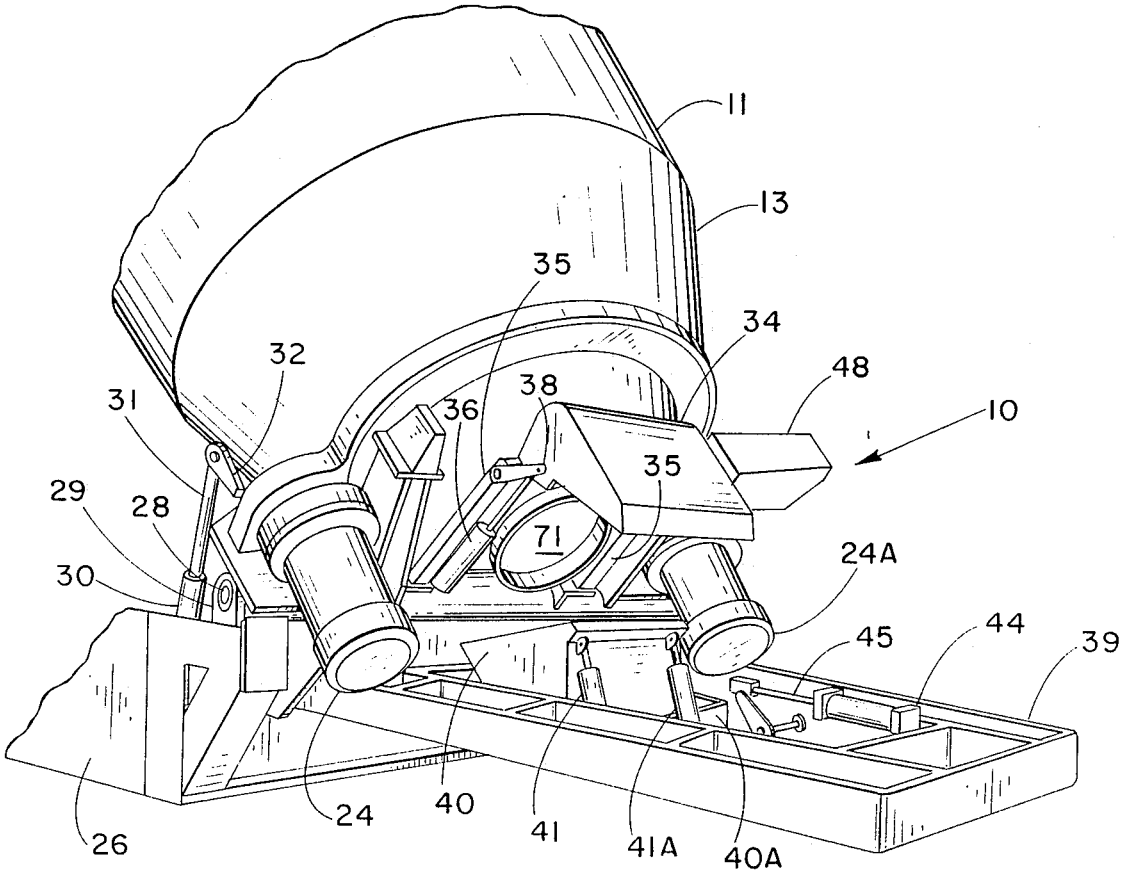

INTEGRAL DUST HOOD FOR TILT MIXER DRUM

Cross reference is made to two related patent applications by the same inventor, namely, Ser. No. 07,483,176 and Ser. No. 07,482,926, filed of even date and assigned to the same assignee as the present application. They involve separate and distinct inventions related to mixing drums for tilt mixers.

BACKGROUND OF THE INVENTION

I. Field of the Invention

The present invention relates generally to mixing drums for batch-style tilt mixers generally and, in particular, those used to blend dry ingredients with water such as in mixing batches of concrete for loading transit carriers including concrete mixer trucks, commonly known as ready-mix trucks. The present invention relates directly to improvements in the drum which reduce the escape of unwanted dust associated with the loading and agitation of the dry ingredients during the using period in which the cement, aggregate and water combine to form concrete.

II. Discussion of the Related Art

Tilt mixers having drums of various types have been used for many years in the construction industry for mixing batches of aggregate, including stone and sand, with finely divided Portland cement and water to form concrete prior to loading the mixture into trucks for transport to the location to where it is to be placed. Over the years, experience has shown it to be most economical to manufacture tilt mixers in a size capable of fully loading a large ready-mix truck but also capable of being themselves transported by truck utilizing the highway system and thereafter mounted for use at an installed mixing plant. Tilt mixers are typically installed in elevated positions so that trucks hauling premixed materials may be loaded from above by tilting the mixer and discharging the mixed contents into a chute above the charging end of the concrete delivery truck.

Tilt mixers are normally designed to be charged to conduct a mixing operation with the longitudinal axis in a substantially horizontal position. In normal batching plant installations, the charging end of the drum closely addresses a fixed loading chute through which it receives measured amounts of aggregate, including stone and sand, Portland cement, and water according to any desired predetermined recipe. The charging end of the drum must be configured so as to clear the chute when the drum is tilted to discharge the mixed materials from the front opening into the discharge chute. The clearance with respect to the front or discharge end of the mixing drum is also important with respect to the loading of the materials into the trucks. Consideration of the height necessary to mount the drum for tilt loading of ready-mix trucks and the clearance for the charging chute are important considerations which must be weighed together with the desire to make the drum itself as close as is reasonable to the ideal mixing shape, in which the length of the drum equals or approaches the diameter of the drum.

Tilt mixers of the class described are usually operated by charging the dry ingredients into the drum through the charging chute and measured amount of water for the batch as the mixing drum is rotated. The dry materials include quantities of stone, sand and finely divided cement which tend to be dusty; and, because the dry ingredients may be agitated for some time before being thoroughly wet by the water in the mix, a great deal of airborne dust may be produced by the loading of the dry ingredients and during the initial stages of mixing. The charging and discharging accesses of the drum are normally rather large round uncovered openings and, for this reason, a great deal of dust may be generated and escape especially from the front or discharge end as the air in the hollow mixing chamber becomes dust laden and is forced out of the discharge opening as entering ingredients displace it.

In this regard various attempts have been made in the prior art to provide the front or discharge end of tilt mixers with dust hoods. These, for the most part, have been devices which are moved into place at the front of the mixing drum for use during mixing but which have to be removed prior to discharging the drum because the space occupied by the dust hood is needed for tilting the drum for discharge of the mixed batch. The need to remove the dust hood prior to discharging the batch also means that there is no hood or other device which might be present to prevent parts of the structure or other nearby devices from being occasionally spattered by wet mixed concrete which may splash out of the discharge chute.

With environmental considerations becoming more and more important in all types of industries, reduction of unwanted airborne dust, which can result in unwanted coatings of cement particles in everything throughout the mixing plant area, and also cause unwanted airborne particles in the local ambient air, has become a necessity. There has long been a need to provide an integral dust hood for concrete mixing devices which would both minimize the amount of dust produced from a discharge end of the tilt mixer drum produced by loading and in the initial stages of concrete mixing. It is also desirable that it be one which would prevent damage or other undesirable consequences of the splashing of mixed concrete during discharge of the drum.

SUMMARY OF THE INvENTION

According to the present invention an improved integrally mounted and operated dust hood is provided for a tilt mixer which minimizes the environmental effect of dust formed in the mixer which escapes from the discharge end of the drum. The integrally mounted dust hood of the invention includes a shaped sheet metal hood member which is mounted from the forward or conical zone of the mixer and hinged from a mating shaped metal member of matching size such that when the hinged hood member is in the closed position it extends over the discharge opening in the front of the conical zone and meets with the stationary matching member to complete a closure extending over the discharge opening. In the preferred embodiment, the discharge hood is adapted to be operated by a fluid cylinder, which may be hydraulic or pneumatic, and which is mounted so as to open and close the hood member in coordination with the operation of the tilting mechanism of the rotary drum. In this manner, when it is desired to tilt the rotating drum for discharge of the mixed materials or batch, the cylinder of the integrally attached dust hood is operated to open the hood so that it clears the discharge chute into which the mixed batch is about to be poured but in a manner such that it also covers the discharge chute as the mixed batch is being poured so that any splashing of the materials will be contained.

In accordance with the integrally mounted dust hood of the invention, an opening may be provided in the hood and a flexible hose attached which may be permanently connected to a dust collector system or other suction device, if desired, such that all the dust generated into the hood is collected further reducing the escape of such unwanted airborne material into the local ambient environment.

The dust hood of the present invention represents a more efficient way of dealing with the dust problem both in terms of being an integral part of the mixing drum itself and eliminating the problem of having to remove and restore it in position from batch to batch.

It should also be noted that the integrally mounted dust hood of the invention in addition to being operated in coordination with the tilting system of the drum, is operable in coordination with the extending and retracting of a telescoping discharge chute which may be provided.

BRIEF DESCRIPTION OF THE DRAWINGS

In the drawings, wherein like numerals are used to designate like parts throughout the same:

FIG. 3 is a front end perspective view of the mixer of FIGS. 1 and 2 disposed in a horizontal or mixing position; and FIG. 4 is a front end perspective view of the mixer of FIG. 3 in the tilted or discharging position.

DESCRIPTION OF THE PREFERRED EMBODIMENT

Figure 1:
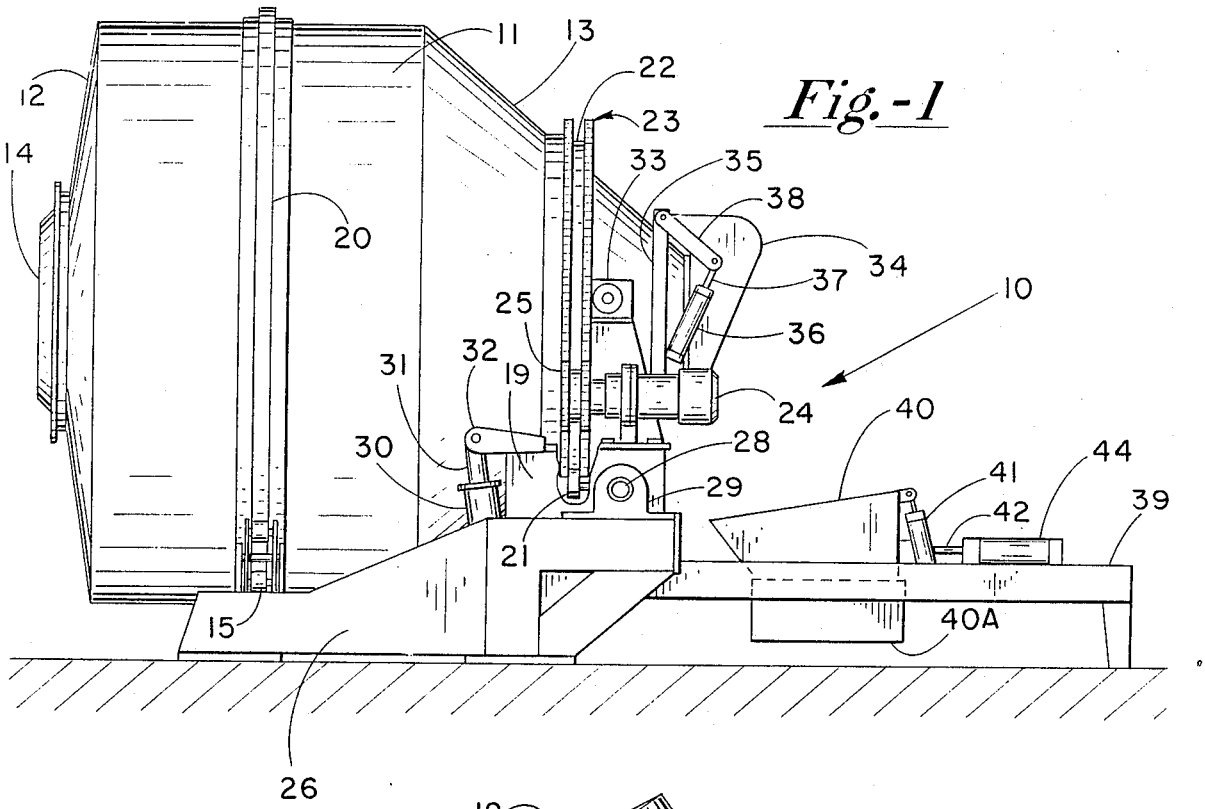
FIG. 1 is a side elevational view of the tilt mixer including an improved mixing drum equipped with the integrally mounted dust hood of the invention.

In accordance with the present invention, an improved mixing drum is provided having an integrally mounted, fully operational dust hood, the operation of which is coordinated with the tilting of the drum and may also be coordinated with the operation of a telescoping discharge hopper. The invention will now be described with reference to the drawing figures of the preferred embodiment, which is meant to be illustrative only, demonstrating the principals but not limiting the scope of the invention.

The figures illustrate a tilt mixing apparatus as it might be mounted on an elevated platform for which only a fragmentary section of the top platform member is illustrated. The mixer includes a rather large diameter drum shown generally at 10 having a generally cylindrically central mixing section 11 flanked by a shallow cone rear charging section 12 and a front conical section 13. The drum 10 is supported for rotation about its longitudinal axis by a dual set of boggy rollers one of which is shown at 15. The rollers are mounted and supported by a cross member, not shown, which is part of a heavy reinforced tilting frame including side member 19 seen in FIG. 2. The boggy rollers are designed to ride in and follow a drum track 20 which circumscribes the generally cylindrical central mixing section 11. Additional rollers as at 21 (FIG. 1) ride within a track 22 between the rows of teeth of a dual-toothed ring gear mounted towards the front of the drum at 23. The drum is adapted to be rotated by a drive system including a pair of synchronous electric motors 24 and 24A which are mounted flanking the front of the conical discharge section 13. The shaft of each motor is connected to a pair of drive gears as at 25 in FIGS. 1 and 2, each pair of drive gears is designed to address a corresponding row of teeth in the ring gear 23. The teeth in the two rows of the ring gear are preferably staggered or off-set preferably by one-half of the gear pitch with respect to each other to reduce both noise and wear occasioned by starting, stopping and driving the heavy drum 10.

The tilting operation of the drum involves pivoting the entire drum by raising the frame on which the drum is mounted with respect to its stationary mount represented by a heavy fixed mounting member 26 located outside of and flanking the tilt frame member 19. The pivot point or axis of rotation preferably resides in a relatively large diameter torque tube illustrated at 50 in FIG. 3 which is attached to a pair of heavy flanking longitudinal axles one of which is shown at 28 and which are suitably journalled into a pair of heavy bearings as illustrated by the pillow block 29. The elevation of the drum 10 is controlled by a pair of fluid operated, preferably hydraulic, cylinder systems as illustrated by cylinder 30 with rod 31 which is pivotally mounted to an arm member 32 attached to supporting structural member 19 in a well-known manner. Additional support for the mixing drum 10 while disposed in an elevated state is provided by a plurality of thrust rollers mounted from the movable frame, one of which is shown at 33, which bear against the side of the ring gears 23 thereby maintaining the position of the drum relative to the other support and drive mechanisms during tilting.

The mixing drum is further provided with an integrally mounted dust hood 34 which is pivotally attached to and mates with similarly shaped shroud member 35 surrounding the discharge opening of the mixing drum. The dust hood 34 is designed to be operated in cooperation with the tilting of the drum and the discharging of the mixed batch by an additional fluid cylinder arrangement including cylinder 36, rod 37 and pivot arm 38 in a manner such that the dust hood 34 is pivoted out of the way prior to the tilting of the drum 10 so that the discharge chute (described below) is adequately cleared and also shrouded by the open hood 34. The opening of the dust hood may be controlled by a suitable electric interlock with a tilt actuator or by other conventional means which would occur to those skilled in the art.

Figure 2:
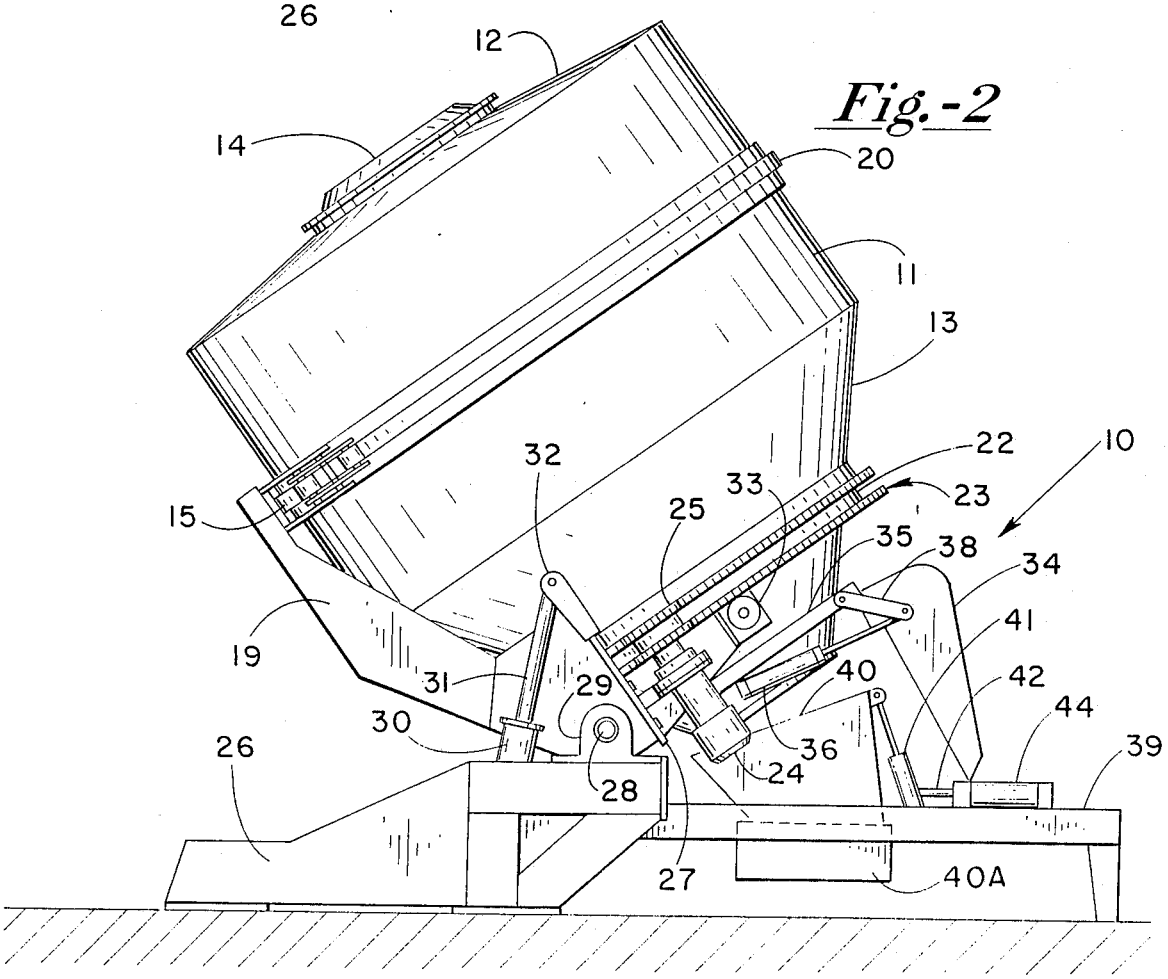
FIG. 2 illustrates the drum of FIG. 1 in the fully tilted or discharging position.

The tilt mixer system further includes a discharge chute arrangement mounted on the elevated frame including a frame member 39 and may be in the form of a two-stage discharge hopper including telescoped stages 40 and 40A shown fully extended and ready to receive mixed materials in FIGS. 2 and 4. The telescoping discharge chute may be cylinder operated as illustrated by a pair of cylinders 41 and 41A. The ability of the two-stage telescoping discharge hopper to fully retract away from the discharge end of the mixing drum increases the allowed clearance underneath the frame by allowing the various parts attached to the mixing drum to clear the hopper at a lower level. After the dust hood 34 is moved out of the way, and, as the drum 10 is tilted, the discharge hopper may then be elevated to meet the discharge end of the mixing drum to coordinate the discharge of the mixed ingredients. The dust hood 34 while retracted sufficiently that the rear of the drum easily clears the discharge chute, is positioned just above the chute such that any splashing from the discharging materials is contained by the tube 34 which is then acting as a shroud. A further cylinder 44 with rod 45 is provided to retract the discharge hopper away from the discharge end of the mixing drum, if desired, or otherwise control the relative location of the discharge chute.

The dust hood 34 may further be provided with an opening 46 which may be connected to a flexible discharge hose 47 which, in turn, may be connected to a dust collecting system illustrated by the container 48 which may apply a vacuum to the hood 34 thereby causing the dusty materials emanating from the discharge opening of the mixer to be carried away for proper disposal or recycling as the case may be.

As may be seen from the foregoing description, the integrally mounted dust hood of the invention when mated with the shroud member 35 provides an essentially dust-tight cover for the discharge end of the mixing drum 10. The coordinated operation of the hinged pivotal dust hood eliminates the need for any device to be moved away and the use of a flexible hose together with a dust collecting device allows removal of the airborne dust without regard to the position of the hood 34.

What is claimed is:

1. An improved rotating, tilting drum mixer for blending batches of dry ingredients with water comprising:

a rear conical charging zone having a central charge opening for receiving materials to be mixed;

a front conical zone having a central discharging opening for discharging mixed materials;

a generally cylindrical central zone separating said charging and discharging zones;

drive means for rotating said drum about its longitudinal axis;

tilting means for tilting the drum to empty mixed material, said tilting means further comprising tilt pivot point means including rotatable áxle support means to support said drum and connected devices and to form the pivot point for tilting said drum and means for causing said drum to tilt;

an integral dust hood comprising a shroud member fixed to said axle support means of said tilt means juxtaposed said discharge opening of said drum, a pivotal hood member hinged to the shroud member in a manner that allows it to cover the discharge opening of said drum when closed and swing clear of said discharge opening when fully opened, and hood operating means for pivoting said dust hood on its hinges.

2. The apparatus of claim 1 further comprising dust collector means connected to said dust hood for removing airborne particulates therefrom.

3. The apparatus of claim 2 wherein the dust collector means applies a vacuum to the dust hood.

4. The apparatus of claim 1 further comprising telescoping discharge chute mounted beneath the front of said drum and associated with the transfer of mixed materials from the drum when tilted, said discharge chute having a telescoping extension section capable of extending upward to meet the discharge end of the drum as the drum is tilted and capable of being retracted so as not to interfere with the operation of said dust hood, and discharge chute operating means for positioning said telescoping section of said discharge chute.

5. The apparatus of claim 4 wherein said telescoping chute member is operated by an hydraulic cylinder arrangement.

6. The apparatus of claim 4 wherein said dust hood is adapted to cover said discharge chute when said hood is opened and said drum is tilted.

7. The apparatus of claim 4 further comprising means for moving said discharge chute in relation to said drum.

8. The apparatus of claim 1 wherein said means for operating said dust hood is an hydraulic operated cylinder arrangement.

9. The apparatus of claim 1 wherein said hood member matches said shroud member when closed.

10. The apparatus of claim 9 further comprising dust collector means connected to the dust hood for removing airborne particulates therefrom.

11. The apparatus of claim 1 wherein said means for causing said drum to tilt is an hydraulic operated cylinder arrangement.

12. The apparatus of claim 1 wherein said rotatable axle support means further comprises a torque tube and wherein said tilt pivot point is located beneath said front control zone of the drum.

13. The apparatus of claim 12 wherein said dust hood shroud member is fixed to said torque tube.

* * * * *